US006913376B2

(12) United States Patent
Judd et al.

(10) Patent No.: US 6,913,376 B2
(45) Date of Patent: Jul. 5, 2005

(54) SEALING BULB BOOT FOR MOVEABLE REFLECTORS

(75) Inventors: Kevin L. Judd, Pendleton, IN (US); Paul H. Fort, Anderson, IN (US); Douglas A. Elrod, Pendleton, IN (US); Robert A. Kidd, Alexandria, IN (US); Jack D. Bodem, Kokomo, IN (US); Vince E. Stanley, Wilkinson, IN (US)

(73) Assignee: Guide Corporation, Pendelton, IN (US)

( * ) Notice: Subject to any disclaimer, the term of this patent is extended or adjusted under 35 U.S.C. 154(b) by 21 days.

(21) Appl. No.: 10/251,005

(22) Filed: Sep. 20, 2002

(65) Prior Publication Data

US 2003/0081427 A1 May 1, 2003

Related U.S. Application Data

(60) Provisional application No. 60/335,402, filed on Oct. 31, 2001.

(51) Int. Cl.[7] ..... F21V 29/00

(52) U.S. Cl. ..... 362/519; 362/549; 362/267; 362/226; 362/548

(58) Field of Search ..... 362/267, 519, 362/548, 549, 507, 226

(56) References Cited

U.S. PATENT DOCUMENTS

| | | | | |
|---|---|---|---|---|
| 3,047,829 A | * | 7/1962 | Mouat | 362/549 |
| 3,749,960 A | | 7/1973 | Fuqua et al. | |
| 4,019,045 A | | 4/1977 | Bassett | |
| 4,427,255 A | * | 1/1984 | Cox | 439/548 |
| 4,634,920 A | | 1/1987 | Rijckaert et al. | |
| 4,709,305 A | * | 11/1987 | McMahan et al. | 362/519 |
| 4,789,920 A | | 12/1988 | Helbig et al. | |
| 4,822,302 A | | 4/1989 | Dorleans | |
| 5,088,011 A | | 2/1992 | Williams et al. | |
| 5,113,320 A | | 5/1992 | Haydu | |
| 5,285,357 A | | 2/1994 | Makita | |
| 5,515,245 A | | 5/1996 | Bobcza et al. | |
| 5,607,218 A | | 3/1997 | Choji | |
| 5,678,915 A | | 10/1997 | Shirai et al. | |
| 5,722,758 A | * | 3/1998 | Huang | 362/548 |
| 5,855,430 A | | 1/1999 | Coushaine et al. | |
| 5,957,569 A | | 9/1999 | Helbig et al. | |
| 6,059,437 A | | 5/2000 | Shibuya et al. | |
| 6,116,755 A | | 9/2000 | Ichihara et al. | |

* cited by examiner

*Primary Examiner*—Thomas M. Sember
(74) *Attorney, Agent, or Firm*—Ice Miller

(57) ABSTRACT

A sealing bulb boot for use in a vehicular lighting assembly comprising a boot with a lip running along its outer perimeter and a hole at its approximate center. The hole in the boot is generally circular in configuration with at least one notch which allows a conventional tabbed locking mechanism of a light source, which requires an approximate quarter turn to lock the light source to the reflector, to pass therethrough. The outer lip of the sealing bulb boot presses around a portion of the housing of the lighting assembly. A seal is also created around the inner portion of the sealing bulb boot upon the insertion of the light source through the hole at the center of the boot and the turning of the light source to engage the light source's locking mechanism.

29 Claims, 5 Drawing Sheets

SEALING BULB BOOT FOR MOVEABLE REFLECTORS

CROSS-REFERENCE TO RELATED APPLICATION

This application claims the benefit of U.S. Provisional Application No. 60/335,402, filed Oct. 31, 2001.

BACKGROUND OF THE INVENTION

The present invention relates generally to vehicular lamps. More specifically, the present invention relates to means used as environmental seals between lamp sockets and moveable reflectors.

All automotive forward lighting assemblies, including headlamps and fog lamps, comprise a light source which provides illumination. The light from this source is directed away from the automobile to illuminate the surface of the road and the space in front of the vehicle by a reflector. Several types of reflectors for vehicular forward lighting assemblies are used in the industry. These include parabolically-shaped reflectors which are used in standard forward lighting assemblies and elliptically-shaped reflectors which are used in projector lamps. In addition to being available in varying shapes, reflectors can also be divided into those that are moveable and those that are fixed. Moveable reflectors allow for the adjustment of the beam of the light source without the need for movement of the entire lighting assembly. To protect the light source from moisture and other harmful environmental effects, the light source is usually enclosed by the reflector and a clear or translucent cover which allows emitted light to pass through but protects the lamp bulb from the elements. However, to fully protect the light source, many lamp assemblies also include an environmental seal around the rear of the reflector known as a sealing bulb boot.

There are several qualities that are desirable in a sealing bulb boot used with a moveable reflector. First, it is desirable and necessary for the sealing bulb boot to form a tight seal around the reflector. This tight seal is required to block moisture and other elements from entering the lamp and potentially causing premature failure of the light source. Second, it is desirable for the sealing bulb boot to seal tightly around the lamp bulb socket without the need for an additional gasket around the base of the socket. The necessity of a separate gasket around the lamp bulb socket would increase the overall cost of the headlamp and therefore should be avoided. Third, it would be desirable for a sealing bulb boot to seal to a moveable reflector that has a simple mold design, preferably one which does not require additional design features over a fixed reflector. Once again this reduces the cost of the fabrication of the piece. Fourth, a successful boot design should be relatively simple to install and require a minimum number of assembly steps to secure to the reflector and around the lamp bulb socket. Any assembly steps which can be eliminated while maintaining a boot that still forms a tight seal saves money in the manufacturing and assembly process.

Current sealing bulb boot designs commonly require that the associated moveable reflector have a groove molded into it for mating with the sealing bulb boot. In particular, the sealing bulb boot is then sealed in such assemblies by being seated into the groove. In the alternative, no groove is used but the sealing bulb boot must be very tight around the "neck" of the light bulb socket to effectuate a seal. The requirement of an extra molded groove increases the price of the reflector. The alternative of a tight fit also adds cost because it makes the sealing bulb boot much more difficult to install. Current boot designs have other shortcomings as well. For example, they commonly require an extra gasket around the lamp socket base to ensure a tight seal. Also, additional means of boot retention may be required to ensure the boot does not come loose and break the environmental seal potentially causing premature light source failure.

Thus, a need exists for a sealing bulb boot which can be manufactured inexpensively, which forms a tight seal around the reflector, and which allows for the simplest assembly possible without the need for additional gaskets or sealing means. Additionally, the sealing bulb boot design should not require additional design features to be molded into the moveable reflector.

BRIEF SUMMARY OF THE INVENTION

The present invention comprises a sealing bulb boot for use with vehicular lighting assemblies, especially automotive forward lighting assemblies, utilizing a moveable reflector. In particular, the sealing bulb boot of the present invention comprises a boot, which may be molded of a flexible material, with a lip running along its outer perimeter and a hole at its approximate center. In an exemplary embodiment of the present invention, the hole in the approximate center of the boot is generally circular in configuration with at least one notch, and in particular for one exemplary embodiment three (3) notches, which allow a conventional tabbed locking mechanism of a light source to pass therethrough. Such tabbed locking mechanisms for automotive light sources, which require an approximate quarter turn of the light source after insertion in the reflector to effectively lock the light source to the reflector, are well known by those of ordinary skill in the art.

In use, the outer lip of the sealing bulb boot presses around a portion of the housing of the lighting assembly. Additionally, a seal is created around the inner portion of the sealing bulb boot upon the insertion of the light source through the hole at the center of the boot and the turning of the light source to engage the light source's quarter turn locking mechanism. Once the light source is locked into place, the sealing bulb boot creates an effective seal around the housing, the light source, and the reflector.

DETAILED DESCRIPTION OF THE INVENTION

Figure 1:
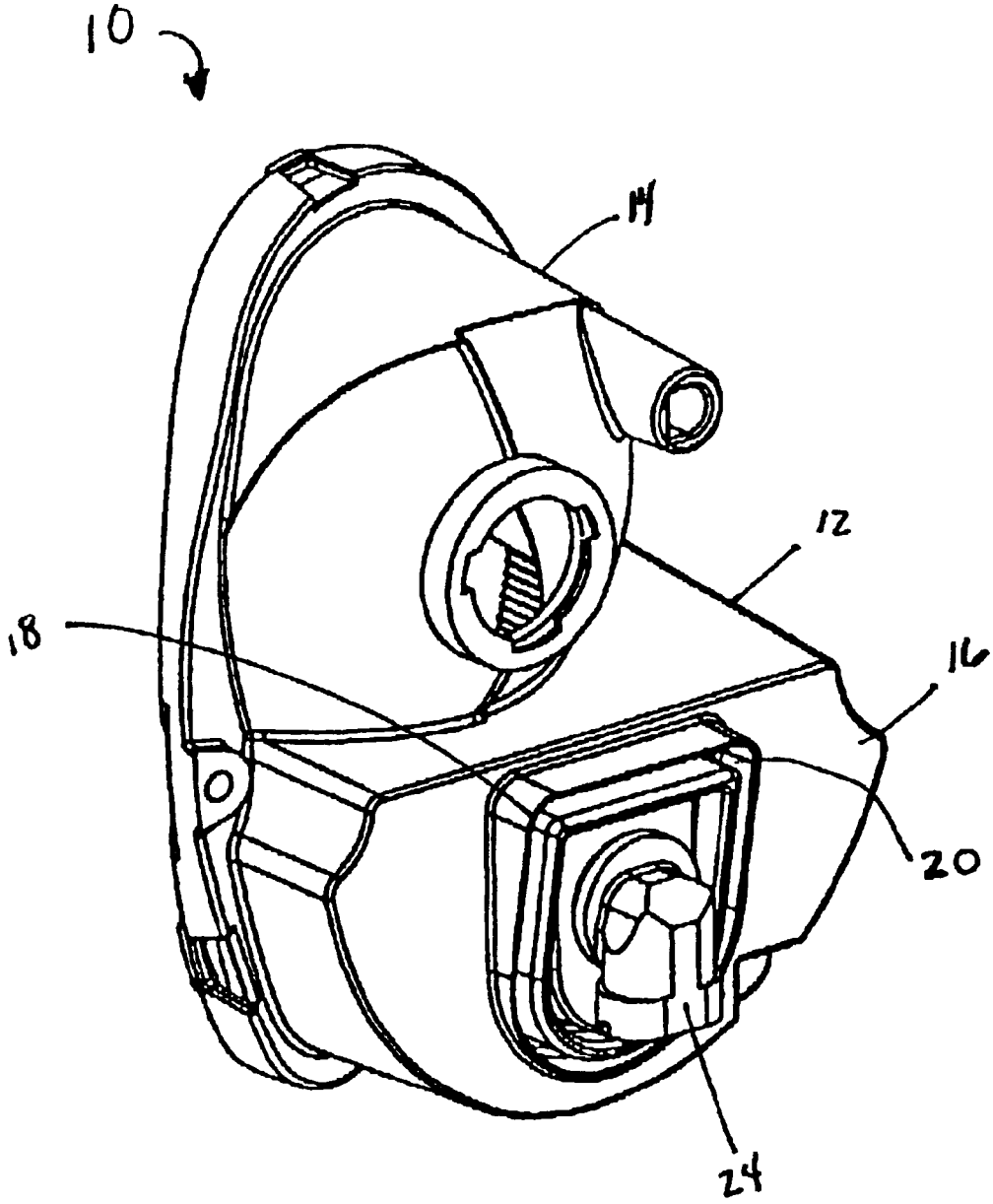
FIG. 1 is a rear perspective view of a vehicular lighting assembly without a sealing bulb boot of the present invention.
Figure 2:
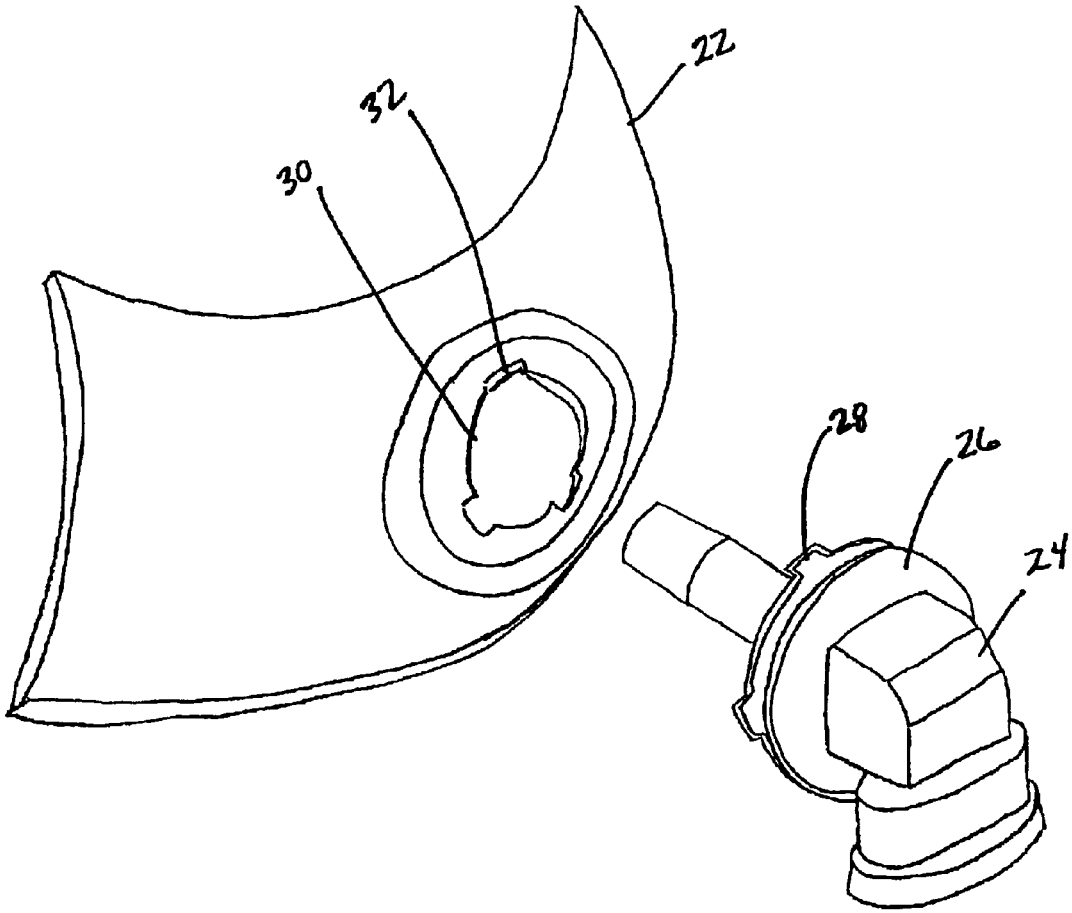
FIG. 2 is a rear perspective view of a light source and a movable reflector without a sealing bulb boot of the present invention.

The present invention provides for a sealing bulb boot for use in a vehicular lighting assembly with a moveable reflector. FIG. 1 shows a rear perspective view of an exemplary automotive forward lighting assembly 10 which comprises housing 12 with signal/drl (i.e., signal/daytime running lamp) portion 14 and fog lamp portion 16. As shown in FIG. 1, fog lamp portion 16 comprises outer ridge 18 and groove 20. Referring now to FIG. 1 and FIG. 2, automotive forward lighting assembly 10 further comprises moveable reflector 22 and light source 24. Light source 24 comprises face plate 26 and locking tabs 28. Moveable reflector 22 comprises opening 30 which is generally circular in cross-section and includes notches 32 which are suitably sized to allow locking tabs 28 of light source 24 to pass therethrough.

In assembly, light source 24 is inserted into opening 30 of moveable reflector 22, in such a manner that locking tabs 28 pass through notches 32. Once inserted, light source 24 is rotated approximately one quarter turn to thereby lock light source 24 into proper position with slots provided in moveable reflector 22 and fixedly secure light source 24 to moveable reflector 22. It should be noted that such one quarter turn locking mechanisms are well known to those of ordinary skill in the art.

Figure 3:
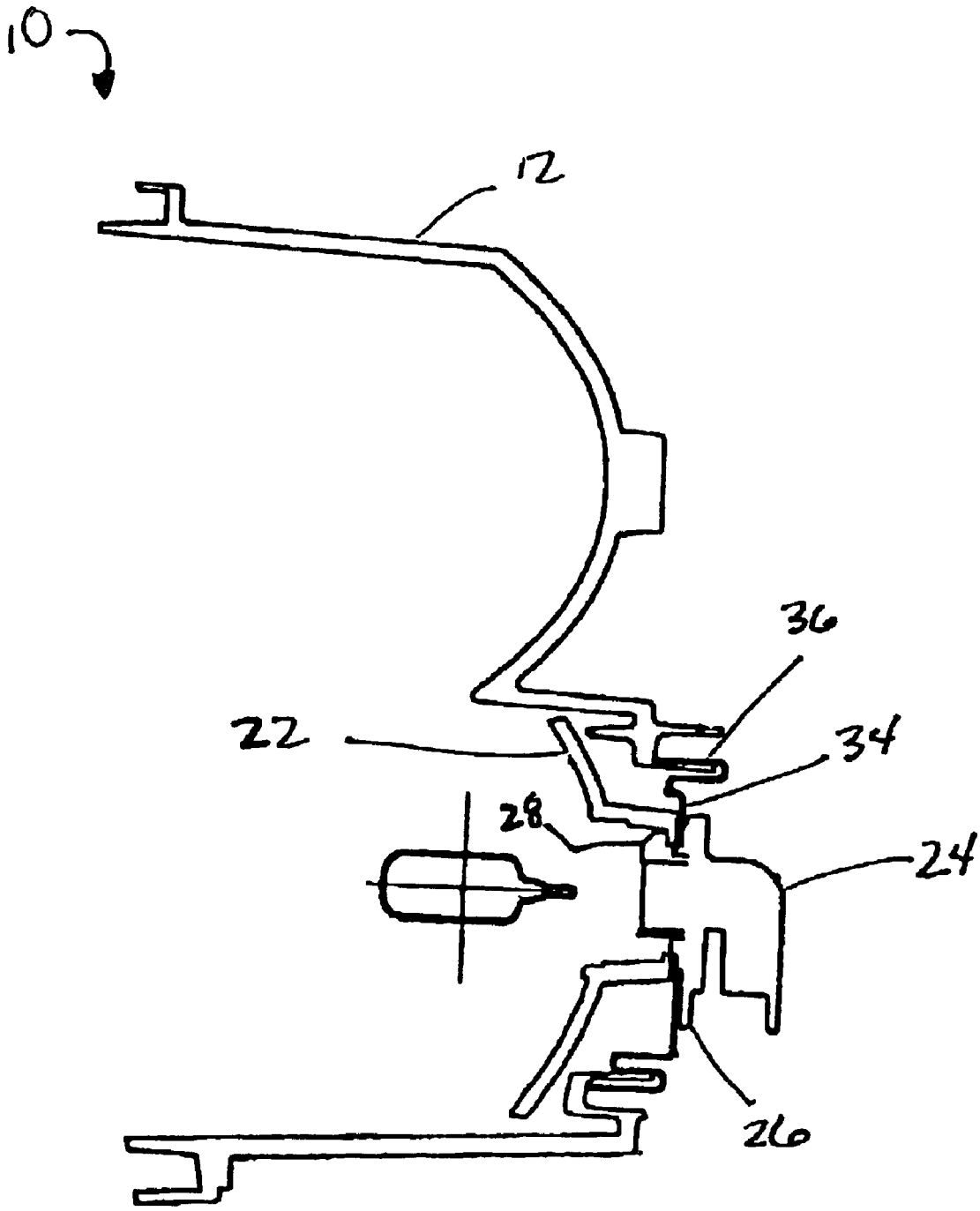
FIG. 3 is a side cross-sectional view of the vehicular lighting assembly of FIG. 1 with an exemplary embodiment of a sealing bulb boot of the present invention.

FIG. 3 shows a cross-section view of automotive forward lighting assembly 10, including an exemplary embodiment of sealing bulb boot 34 of the present invention. Sealing bulb boot 34 is molded from a flexible material with outer lip 36 running along its outer perimeter. In particular, sealing bulb boot 34 may be molded through an injection molding process from a black thermoplastic rubber compound, which is commercially available from the American Rubber company. Sealing bulb boot 34 may also be molded from a black solid rubber material per SAEJ200. Outer lip 36 fits around outer ridge 18 of housing 12 and presses into groove 20.

Figure 4:
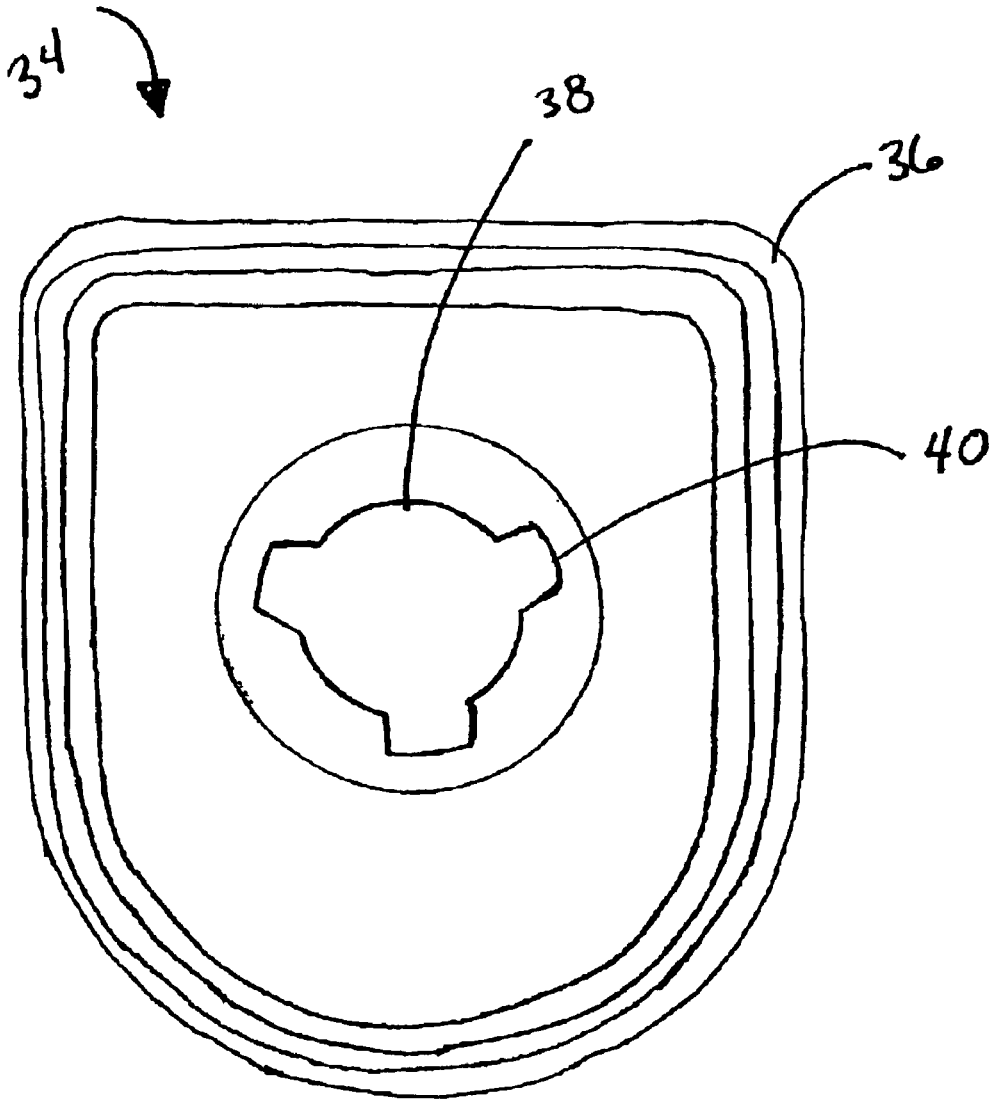
FIG. 4 is a rear view of the exemplary embodiment of the sealing bulb boot of the present invention shown in FIG. 3.
Figure 5:
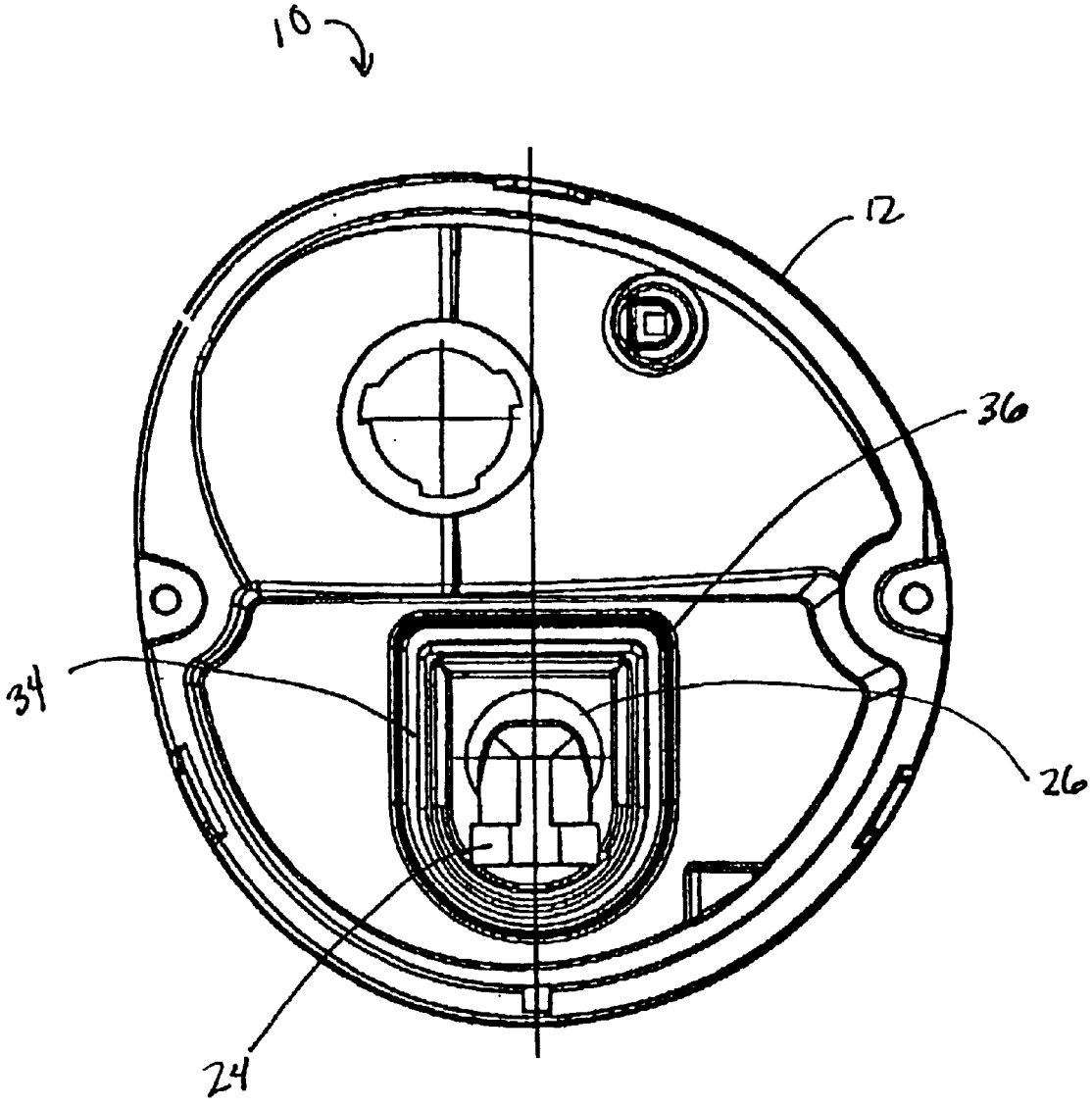
FIG. 5 is a rear view of the vehicular lighting assembly of FIG. 1 with the exemplary embodiment of the sealing bulb boot of the present invention shown in FIG. 3.

Referring to FIG. 4, which shows a rear view of an exemplary embodiment of sealing bulb boot 34, sealing bulb boot 34 is molded with boot opening 38 at its approximate center. Boot opening 38 is generally circular in cross-section but includes, in this exemplary embodiment, a plurality of boot notches 40. It will be appreciated by those of ordinary skill in the art that other exemplary embodiments of sealing bulb boot 34 may include only a single boot notch 40 or any plurality of boot notches 40. Generally, the number of boot notches 40 in sealing bulb boot 34 will directly correspond in size, number and shape to locking tabs 28 of light source 24. Additionally, if light source 24 contains some locking mechanism other than locking tabs 28, such as, for example, clips, then booting opening 38 and any necessary boot notches 40 would simply be modified appropriately to accept such other locking mechanism. FIG. 5 shows a rear view of automotive forward lighting assembly 10 with an exemplary embodiment of sealing bulb boot 34 in place.

During the assembly process, sealing bulb boot 34 is placed on housing 12 with outer lip 36 fitting around outer ridge 18. Sealing bulb boot 34 is sized such that outer lip 36 fits tightly around outer ridge 18 and presses into groove 20, thereby creating a tight seal around the outer perimeter of sealing bulb boot 34. Next, light source 24 is inserted through boot opening 38 and opening 30 in moveable reflector 22. Light source 24 is inserted in such a position that allows locking tabs 28 to pass through boot notches 40 and notches 32 in moveable reflector 22. As described above, light source 24 is then turned approximately one quarter turn so that locking tabs 28 lock into position with slots provided in moveable reflector 22. This fixedly locks light source 24 to moveable reflector 22 and firmly seats the inner portion of sealing bulb boot 34 between light source 24 and moveable reflector 22. Thus, the locking mechanism of light source 24 forms a tight seal around the inner portion of sealing bulb boot 34.

The present invention allows for sealing bulb boot 34 to be firmly seated between moveable reflector 22 and light source 24 with a simple turn of light source 24. The tight seal formed does not require any additional grooves to be molded into moveable reflector 22. Also, no additional gasket is required to create a seal around light source 24. In addition, positioning sealing bulb boot 34 between light source 24 and moveable reflector 22 forms a tight seal that does not require the use of additional means to retain sealing bulb boot 34.

By eliminating the need for additional means to retain sealing bulb boot 34 and the need for an additional gasket around light source 24, manufacturing costs can be lowered. Furthermore, the fact that sealing bulb boot 34 is firmly seated into place through the locking mechanism that fixedly secures light source 24 to moveable reflector 22 eliminates the need for additional grooves to be molded into moveable reflector 22 and minimizes the number of manufacturing steps required to firmly seat sealing bulb boot 34. Additionally, sealing bulb boot 34 does not need to be tightly fit around the "neck" of light source 24, thus further increasing the efficiency of the assembly process.

While the present invention has been described in considerable detail with reference to particular embodiments thereof, such is offered by way of non-limiting examples of the invention as many other versions are possible. For example, the automotive forward lighting assembly described herein was offered as but one example of such an assembly. Sealing bulb boot 34 could be utilized with many different vehicular lighting assemblies, such as for example, lighting assemblies for boats, planes, industrial equipment, as well as other automotive lighting applications. Additionally, it is anticipated that a variety of other modifications and changes will be apparent to those having ordinary skill in the art and that such modifications and changes are intended to be encompassed within the spirit and scope of the invention as defined by the appended claims.

What is claimed is:

1. A sealing bulb boot for use with a moveable reflector vehicle lighting assembly having a housing with a first opening therethrough and with a ridge around said first opening, a moveable reflector positioned within said housing, said reflector having a second opening formed through said reflector, and a light source with at least one tab projecting radially outwardly therefrom said dimensioned to engage a recess formed in said second opening through said reflector, the sealing bulb boot comprising:

an outer perimeter, said outer perimeter comprising an outer lip that is sealing second around the ridge, and a third opening formed through said boot located interior to said outer perimeter, said third opening comprising at least one notch formed along a peripheral edge of said third opening, wherein said light source is positioned through said third opening in said boot, and into said second opening through said reflector and in engagement with said reflector to retain said boot against said reflector.

2. The sealing bulb boot of claim 1 wherein said third opening is located at approximately the center of said sealing bulb boot.

3. The sealing bulb boot of claim 1 wherein said third opening comprises three notches.

4. The sealing bulb boot of claim 1 wherein said sealing bulb boot is molded from a flexible material.

5. The sealing bulb boot of claim 4 wherein said flexible material is a thermoplastic rubber compound.

6. The sealing bulb boot of claim 4 wherein said sealing bulb boot is manufactured by injection molding.

7. The sealing bulb boot of claim 1 wherein the at least one tab is placed through said at least one notch of said third opening.

8. The sealing bulb boot of claim 7 wherein the light source is rotated to sealingly connect the light source, the moveable reflector, and said sealing bulb boot.

9. A sealing bulb boot for use in a vehicle forward lighting assembly having a housing with a ridge, a moveable reflector, and a light source having a means for securing the light source to the moveable reflector, said sealing bulb boot comprising:

an outer perimeter comprising an outer lip designed and dimensioned to said outer lip fit sealingly around the ridge;

an opening located interior to said outer perimeter, said opening comprising at least one notch designed and dimensioned to pass the means for securing the light source to the moveable reflector; and wherein the light source is placed through said opening and the means for securing the light source to the moveable reflector attaches the light source and sealing bulb boot to the movable reflector sealingly secures the light source and the moveable reflector to said sealing bulb boot, so that the sealing bulb boot is retained by and forms a seal between the light source and reflector.

10. The sealing bulb boot of claim 9 wherein said opening is located at approximately the center of said sealing bulb boot.

11. The sealing bulb boot of claim 9 wherein said opening comprises three notches.

12. The sealing bulb boot of claim 11 wherein said means for securing the light source to the moveable reflector comprises three tabs.

13. The sealing bulb boot of claim 12 wherein the three tabs are inserted through said three notches and the light source is rotated to sealingly connect the light source, the moveable reflector and said sealing bulb boot.

14. The sealing bulb boot of claim 9 wherein said sealing bulb boot is molded from a flexible material.

15. The sealing bulb boot of claim 14 wherein said flexible material is a black thermoplastic rubber compound.

16. The sealing bulb boot of claim 14 wherein said sealing bulb boot is manufactured by injection molding.

17. The sealing bulb boot of claim 9 wherein said means for securing the light source to the moveable reflector comprises at least one tab.

18. The sealing bulb boot of claim 17 wherein the light source is rotated to sealingly connect the light source, the moveable reflector, and said sealing bulb boot.

19. A vehicle lighting assembly comprising:

(a) a housing having an opening and a groove formed around said opening;

(b) a lamp socket with at least one locking tab;

(c) a reflector within said housing said reflector having an opening formed therethrough, said opening in said reflector having at least one notch adapted to receive and engage said at least one locking tab;

(d) a sealing bulb boot comprising (i) an interior edge that defines an opening through said boot; and (ii) an outer lip around an exterior edge of said boot;

wherein the outer lip is pressed into the groove and interior edge is firmly seated and compressed between and by the lamp socket and housing when the at least one locking tab is locked into the at least one notch in the opening in the reflector order to form a seal between the lamp socket and reflector.

20. The vehicle lighting assembly of claim 19, wherein said opening comprises at least one notch.

21. The vehicle lighting assembly of claim 19, wherein said sealing bulb boot is molded from a thermoplastic rubber compound.

22. The vehicle lighting assembly of claim 19, wherein said lamp socket further comprises a face plate such that the sealing bulb boot is en pressed between the housing and the face plate.

23. The vehicle lighting assembly of claim 20, wherein the at least one tab is placed through said at least one notch of said opening.

24. The vehicle lighting assembly of claim 23, wherein the lamp socket is rotated to sealingly connect the lamp socket, the reflector, and aid sealing bulb boot.

25. A method of forming an environmental seal between a lamp socket and a reflector comprising the steps of:

(a) providing a forward lighting assembly having a housing with outer ridge, an inner ridge, and a groove located in between the outer and inner ridges and a reflector positioned within said housing with an opening through said reflector;

(b) providing a sealing bulb boot having an interior edge that defines an opening through said boot and an outer lip that surrounds the interior edge;

(c) pressing the outer lip of the sealing boot into the groove;

(d) inserting the lamp socket through the opening of the sealing bulb boot and through the opening of the reflector; and (e) locking the lamp socket to the reflector so that the interior edge of the sealing bulb boot is firmly seated in between the lamp socket and the reflector.

26. The method of claim 25, wherein said opening comprises at least one notch.

27. The method of claim 26 wherein id lamp socket comprises at least one locking tab.

28. The method of claim 27, further comprising the step of placing the at least on tab through the at least one notch.

29. The method of claim 28, further comprising the step of rotating the lamp bulb socket to sealingly connect the lamp socket, the reflector, and said sealing bulb boot.

* * * * *